US005210513A

United States Patent [19]

Khan et al.

[11] Patent Number: 5,210,513

[45] Date of Patent: May 11, 1993

[54] COOLING OF ELECTROMAGNETIC APPARATUS

[75] Inventors: Iftikhar A. Khan; James W. Wobschall, both of Indianapolis, Ind.

[73] Assignee: General Motors Corporation, Detroit, Mich.

[21] Appl. No.: 855,385

[22] Filed: Mar. 20, 1992

[51] Int. Cl.[5] ..... H01F 27/08

[52] U.S. Cl. ..... 336/61; 336/65; 336/83; 336/233

[58] Field of Search ..... 336/65, 67, 61, 55, 336/83, 98, 233

[56] References Cited

U.S. PATENT DOCUMENTS

| | | | |
|---|---|---|---|
| 1,174,225 | 3/1916 | Bliss | 336/65 |
| 2,361,249 | 10/1944 | Venable | 175/361 |
| 2,641,743 | 6/1953 | Bonanno | 336/65 |
| 2,741,528 | 4/1956 | Clark et al. | 336/98 |
| 2,770,785 | 11/1956 | Haagens et al. | 336/61 |
| 2,992,405 | 7/1961 | Ursch | 336/55 |
| 3,007,125 | 10/1961 | Furbre | 336/65 |
| 3,129,399 | 4/1964 | Hansen | 336/98 |
| 3,134,467 | 5/1964 | Blyth | 336/65 |
| 3,617,966 | 11/1971 | Trench | 336/61 |
| 3,810,303 | 5/1974 | Hoell | 29/605 |
| 3,883,834 | 5/1975 | Osteen | 336/61 |
| 4,081,776 | 3/1978 | Hisamoto et al. | 336/61 |
| 4,082,141 | 4/1978 | Perretta | 336/61 |
| 4,509,032 | 4/1985 | Post | 336/83 |
| 4,736,179 | 4/1988 | Behnke et al. | 336/61 |
| 4,924,200 | 5/1990 | Kitahara et al. | 336/65 |
| 4,956,626 | 9/1990 | Hoppe et al. | 336/60 |

*Primary Examiner*—Thomas J. Kozma
*Attorney, Agent, or Firm*—Creighton R. Meland

[57] ABSTRACT

An electromagnetic apparatus such as a transformer or a single winding inductor is provided with a cooling arrangement. The apparatus has a magnetic core and a coil winding disposed about and carried by a leg of the core. The magnetic core has legs connected to the leg that carries the coil winding and these legs have flat surfaces that directly contact a flat surface of a metallic heat sink to thereby provide a direct heat conductive path from the legs to the heat sink. Heat generated in the coil winding is transferred to the heat sink via the leg that carries the coil winding and then to the heat sink via the legs that directly engage the heat sink. Heat generated in the magnetic core due to hysteresis or eddy current loss is also transferred to the heat sink.

2 Claims, 4 Drawing Sheets

COOLING OF ELECTROMAGNETIC APPARATUS

This invention relates to the cooling of electromagnetic apparatus such as transformers and inductors.

In the operation of electromagnetic apparatus that have a magnetic core and one or more coils or windings, heat is generated in the coil windings by current supplied to the coil winding and in the magnetic core due, for example, to hysteresis and eddy current losses.

One way of cooling electromagnetic apparatus is to place the magnetic core of the apparatus in direct contact with a metallic heat sink so that heat generated in the coil winding and core are transferred from the core to the heat sink and dissipated by the heat sink. In some types of electromagnetic apparatus, the core has a so-called EE or EI shape with a center leg that carries the coil winding. With such a core shape, the magnetic core may be defined by an outer rectangular core portion where two sides of the rectangular core portion are connected by the center leg. In a core shape of the type that has been described certain portions of the coil winding that is carried by the center leg are located outwardly of certain surfaces of the rectangular portion of the core. Because of this, certain flat surfaces of the rectangular portion of the core cannot be mounted in direct engagement with a flat planar surface of a heat sink because the portion of the coil winding that is located outwardly of the flat surfaces of the rectangular portion of the core do not permit such direct engagement.

It, accordingly, is an object of this invention to provide an electromagnetic apparatus that includes a magnetic core that is comprised of an outer portion and a leg that connects parts of the outer portion, wherein the leg carries a coil winding, and further wherein the core and a heat sink are configured such that flat surface portions of the outer portion of the core directly engage or contact flat surfaces of the heat sink to provide a good heat conductive path between the core and the heat sink.

In accordance with one aspect of this invention, the magnetic core is comprised of an outer rectangular core portion and a center leg that connects two sides of the rectangular portion. The center leg carries a coil winding and certain portions of the coil winding are located outwardly of certain surfaces of the rectangular portion. These surfaces of the rectangular portion of the core are mounted in direct contact with certain heat sink surfaces of a heat sink. These heat sink surfaces are located at the end of a rectangular spacer wall of the heat sink where the rectangular spacer wall extends axially from a surface of the main body portion of the heat sink. The axial length or height of the rectangular spacer wall is such that an outer portion of the coil winding is spaced from a surface of the main body portion of the heat sink.

In accordance with another aspect of this invention, the magnetic core has an outer rectangular wall portion and a center leg connecting two sides of the rectangular wall portion. The center leg carries a coil winding and a surface of the rectangular wall portion directly contacts or engages a flat planar surface of a metallic heat sink. The axial length of the part of the rectangular wall portion disposed between the center leg and the planar surface of the heat sink is such that an outer portion of said coil winding is spaced from a planar surface of the heat sink.

IN THE DRAWINGS

Figure 1:
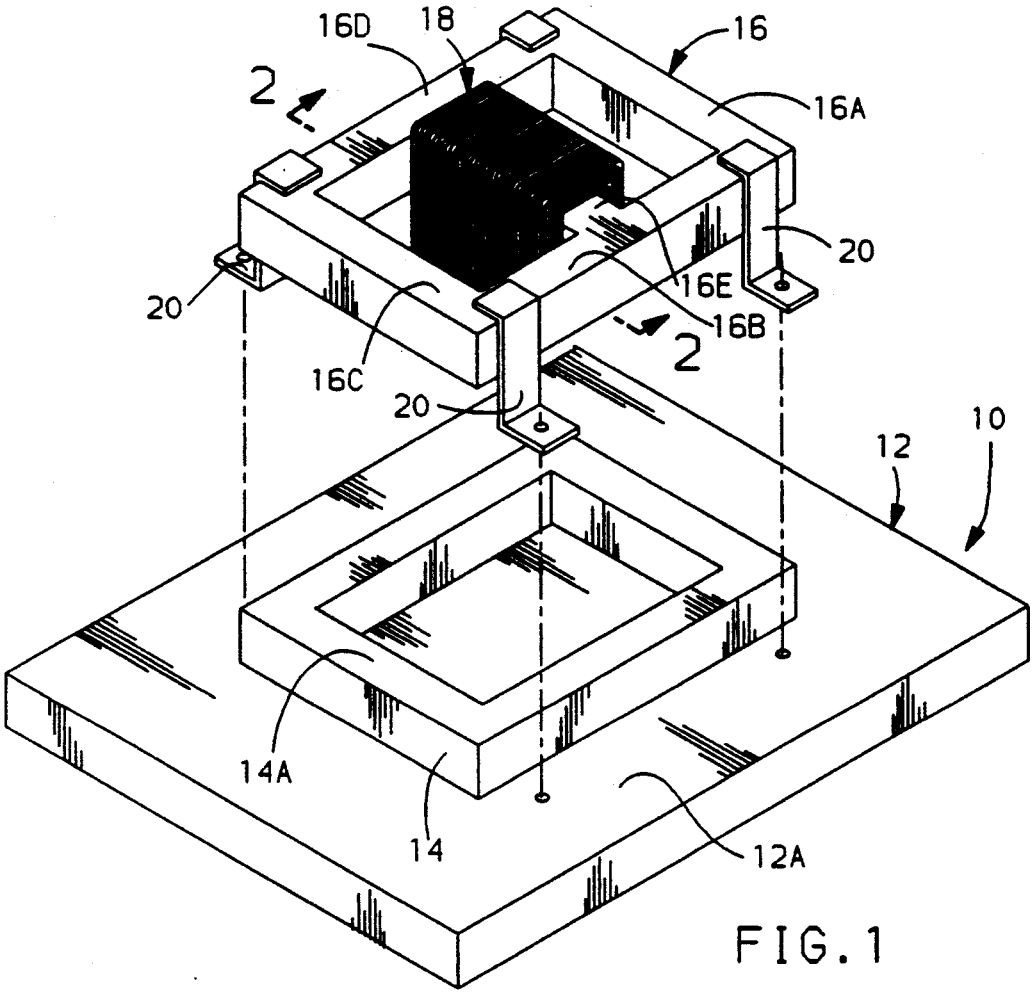
FIG. 1 is an exploded perspective view of an electromagnetic apparatus made in accordance with this invention.
Figure 2:
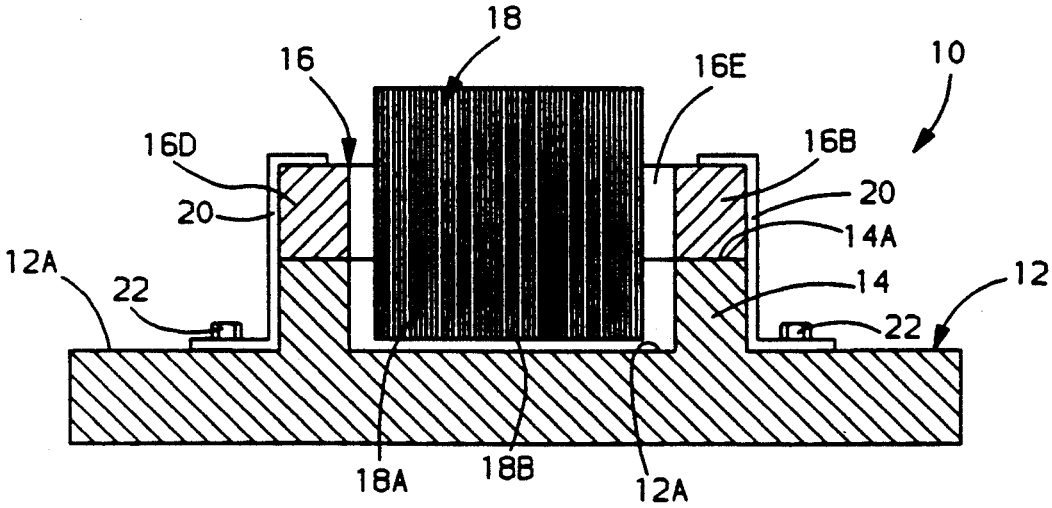
FIG. 2 is a sectional view taken along line 2—2 of FIG. 1.

Referring now to the drawings, and more particularly to FIGS. 1 and 2, an electromagnetic apparatus is illustrated which includes a laterally extending metallic heat sink 10 which is formed of a material having high thermal conductivity, such as aluminum. The heat sink 10 has a main body portion 12 and a rectangular wall 14 carried by portion 12. The main body portion 12 has a flat planar surface 12A and the rectangular portion 14 of the heat sink extends axially from surface 12A. The rectangular wall 14 can be integral with main body portion 12 or could be a separate piece that is secured to main body portion 12. The rectangular wall 14 is formed of the same material as the main body portion.

The heat sink 12 is attached to a magnetic core generally designated as 16. The core 16 has an outer rectangular portion comprised of legs 16A, 16B, 16C and 16D and a center leg 16E connected between legs 16B and 16D. All of these legs have a rectangular cross-section. The core 16 is formed of a magnetic material and may be formed, for example, from steel laminations or compressed iron powder. Core 16 can be comprised of two E-shaped parts or from one E-shaped and one I-shaped part as is well known to those skilled in the art.

The center leg 16E of core 16 carries a rectangular coil winding 18 which may be comprised of a number of turns of insulated copper wire that are disposed about the leg 16E. The inner turns of coil winding 18 directly contact outer surfaces of center leg 16E to provide a good heat transfer path between coil 18 and center leg 16E. To provide extra electrical insulation the outer surfaces of leg 16E can be provided with a thin coating of electrical insulating material that has a good heat transfer property.

Only one coil winding 18 is shown in FIGS. 1 and 2. It will be appreciated, however, that the leg 16E could carry more than one coil winding, for example, where the electromagnetic apparatus is a transformer.

The core 16 is secured to heat sink 10 by means of brackets 20 and screw fasteners 22 that are threaded into threaded holes formed in the main body portion 12 of heat sink 10.

The upper rectangular surface 14A of rectangular wall 14 directly contacts or engages the lower surfaces of legs 16A, 16B, 16C and 16D. Further, the width of surface 14A is the same as the width of the respective lower surfaces of legs 16A-16D.

Consequently, the total lower surface area made up of the lower surfaces of legs 16A–16D is in direct contact with the total upper surface area surface 14A.

It can be appreciated that the heat generated in coil 18 will be transferred to the main body portion 12 of heat sink 10 via center leg 16E to outer legs 16A–16D and then from the outer legs 16A–16D to body portion 12 of heat sink 10 via rectangular wall 14. Further, any heat generated in core 16 due, for example, to hysteresis or eddy current losses is transferred to main body portion 12 via rectangular wall 14. Heat is then dissipated by heat sink 10 and accordingly heat sink 10 operates as a heat dissapator.

With reference to FIG. 2, it can be seen that portion 18A of coil winding 18 is disposed within rectangular wall 14 and that the outer edge portion 18B of coil winding 18 is slightly spaced from flat surface 12A. Thus, due to the provision of rectangular wall 14 the lower surfaces of legs 16A–16D of core 16 can directly contact surface 14A on heat sink 10. Putting it another way, if rectangular wall 14 were not provided, it would not be possible to directly contact the lower surfaces of legs 16A–16D with flat surface 12A because the outer edge 18B of coil 18 would engage surface 12A before any contact could be made between the lower surfaces of legs 16A–16D and surface 12A.

Figure 3:
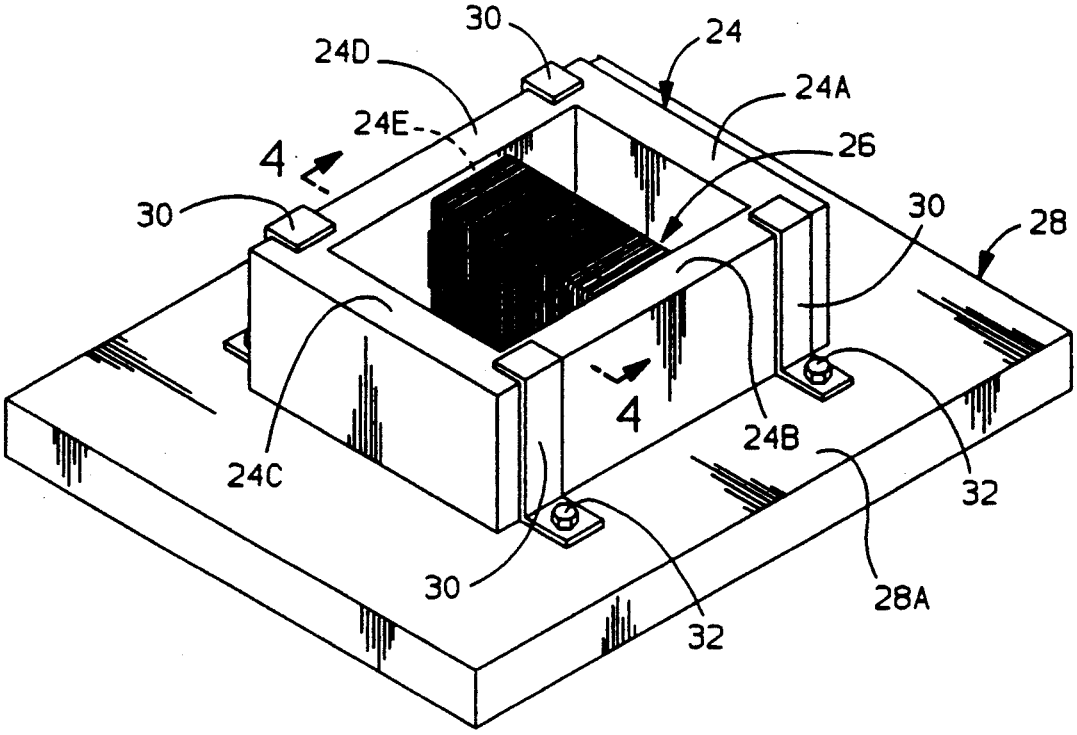
FIG. 3 is a perspective view of a modified electromagnetic apparatus made in accordance with this invention.
Figure 4:
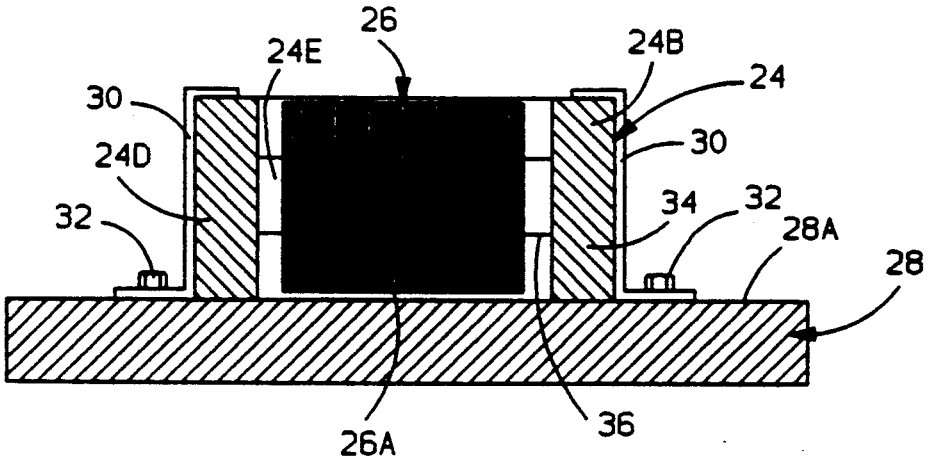
FIG. 4 is a sectional view taken along line 4—4 of FIG. 3.

Referring to FIGS. 3 and 4, another embodiment of the invention is disclosed. In the embodiment of FIGS. 3 and 4, the heat sink does not have a rectangular wall like wall 14 of FIG. 1. Instead of providing a wall, like wall 14, the outer legs of the magnetic core are longer in axial length as compared to the legs of the core shown in FIGS. 1 and 2 to permit direct contact between the lower surfaces of the outer legs of the core and surfaces of the heat sink.

In FIGS. 3 and 4 the magnetic core is generally designated as 24. This core has outer legs 24A, 24B, 24C and 24D that define a rectangular outer core. The outer legs 24B and 24D are connected by a center leg 24E. Legs 24A–24E are all rectangular in cross-section. Core 24 can be formed of the same type of magnetic material as core 16 and can be formed by two E-shaped parts or one E-shaped part and one I-shaped part.

A rectangular coil winding 26 is disposed about and carried by center leg 24E of core 24. Like the embodiment of FIGS. 1 and 2, the inner turns of coil winding 26 engage outer surfaces of center leg 24.

The legs 24A–24D are somewhat thinner than legs 16A–16D, but have a greater height or axial length.

The embodiment of FIGS. 3 and 4 has a heat sink 28 that has a planar flat surface 28A.

The magnetic core 24 is secured to heat sink 28 by brackets 30 and screw fasteners 32.

The entire lower surfaces of legs 24A, 24B, 24C and 24D directly contact or directly engage the flat planar surface 28A of heat sink 28. Consequently, there is a direct heat conductive path between legs 24A–24D and heat sink 28.

In the embodiment of FIGS. 3 and 4, the lower portions of the legs 24A–24D are long enough to cause the lower edge 26A of coil 26 to be spaced from surface 28A of heat sink 28. Thus, taking leg 24B as an example, the lower portion 34 thereof, that extends from a lower surface 36 of center leg 24E to surface 28A, is longer than that portion of the coil winding 26 that extends between the lower surface 36 of core 24E and the outer edge 26A of coil 26. Accordingly, the lower surface of legs 24A–24D can directly contact surface 28A of heat sink 28 without coil winding 26 interfering with such direct contact.

Figure 5:
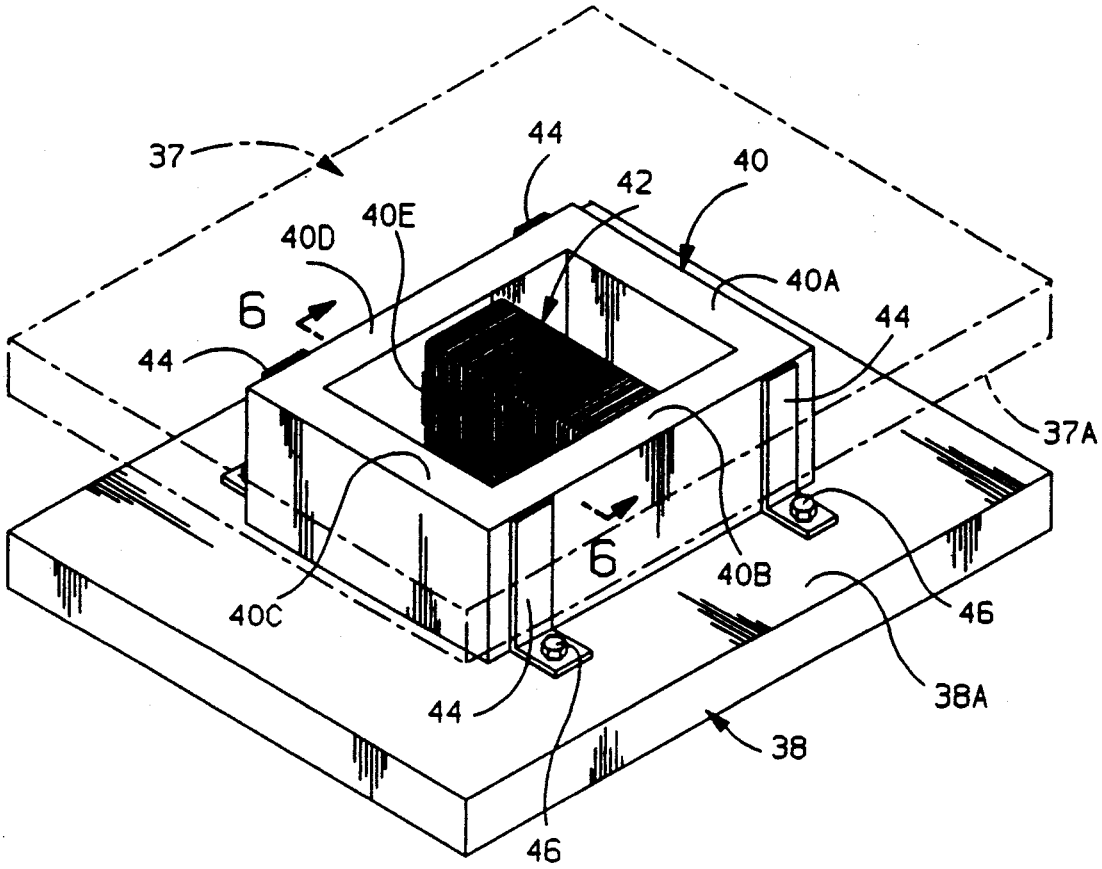
FIG. 5 is a perspective view of an electromagnetic apparatus made in accordance with this invention that utilizes two heat sinks.
Figure 6:
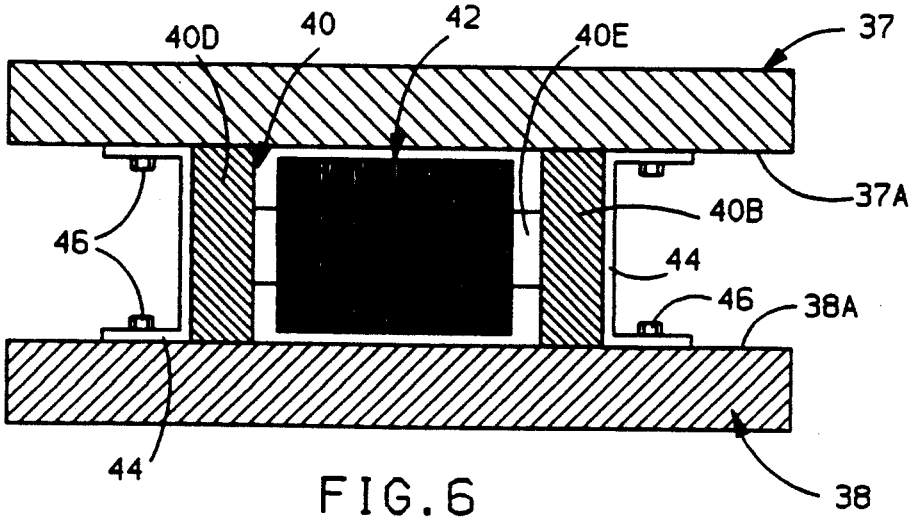
FIG. 6 is a sectional view taken along line 6—6 of FIG. 5.

The embodiment of the invention shown in FIGS. 5 and 6 differs from the embodiment of the invention shown in FIGS. 3 and 4 in that two heat sinks are used instead of one heat sink.

In the embodiment of FIGS. 5 and 6 two heat sinks 37 and 38 are provided. The magnetic core, generally designated as 40, is comprised of outer legs 40A, 40B, 40C and 40D. Outer legs 40B and 40D are connected by center leg 40E which carries rectangular coil winding 42.

The core 40 is secured to heat sinks 37 and 38 by brackets 44 and screw fasteners 46.

In the embodiment of FIGS. 5 and 6 the upper end surfaces of outer legs 40A–40D directly contact a planar flat surface 37A of heat sink 37. The lower end surfaces of outer legs 40A–40D directly contact the planar flat surface 38A of heat sink 38. It can be appreciated that in the embodiment of FIGS. 5 and 6 heat is transferred from outer legs 40A–40D to both heat sinks 37 and 38.

It can be appreciated from an inspection of FIG. 6 that opposite end portions of legs 40A–40D are long enough to allow opposite end surfaces of legs 40A–40D to directly respectively contact heat sinks 37 and 38 without coil winding 42 interfering with such direct contact.

The embodiment of the invention shown in FIGS. 7 and 8 will now be described. In this embodiment, the magnetic core is generally designated as 50. Core 50 is made up of two parts. One part has an outer leg 52 connected to leg portions 54 and 56 that are normal to leg 52. Leg 52 and portions 54 and 56 have a rectangular cross-section. The other part has a leg 58 that is connected to leg portions 60 and 62 that are normal to leg 58. Leg 58 and portions 60 and 62 have a rectangular cross-section. The end surfaces of leg portions 54 and 62 are engaged as are the end surfaces of leg portions 56 and 60. A rectangular coil winding 64 is disposed about and carried by leg portions 54 and 62 which, in effect, provide a single leg that carries coil winding 64. In a similar fashion, a coil winding 66 is disposed about and carried by leg portions 56 and 60. The coil windings 64 and 66 may be the primary and secondary windings of a transformer.

The magnetic core 50 is attached to a metallic heat sink 68 by brackets 70 and screw fasteners 72. The metallic heat sink 68 has a flat planar surface 68A which directly contacts the entire lower end surfaces 52A and 58A of core legs 52 and 58.

The length of the lower portions of legs 52 and 58, for example, the length of leg 52 between surface 52A and a lower surface of leg portion 54 is long enough to permit surfaces 52A and 58A to directly contact surface 68A without coils 64 and 66 interfering with such direct contact. Putting it another way, the lower outer edges of coil 64 and 66 are spaced from surface 68A due to the height of the lower portions of legs 52 and 58.

Figure 7:
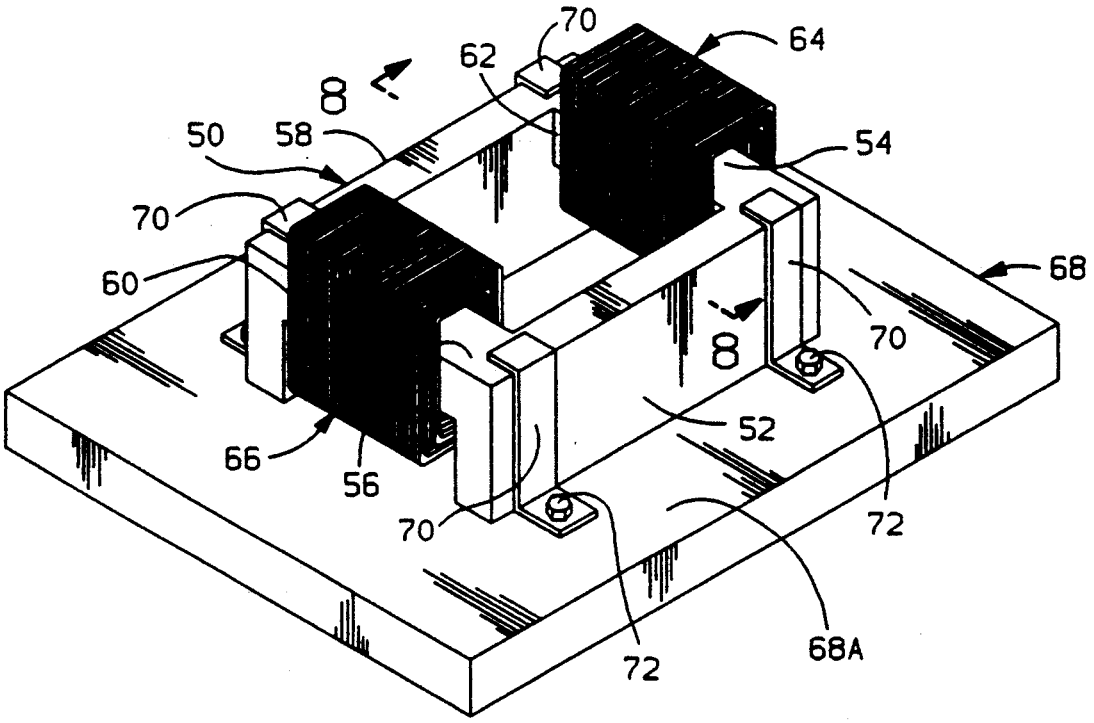
FIG. 7 is a perspective view of an electromagnetic apparatus made in accordance with this invention that has two core legs each of which carries a coil winding.
Figure 8:
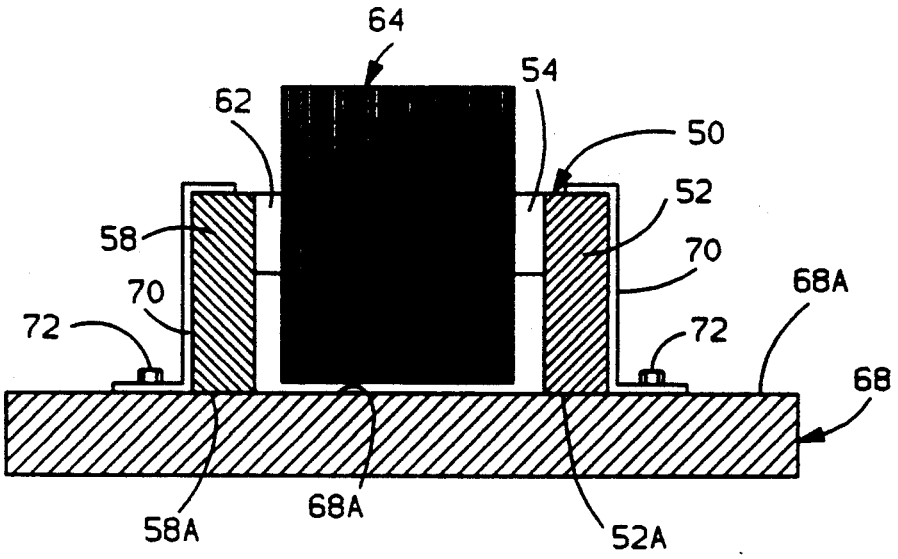
FIG. 8 is a sectional view taken along line 8—8 of FIG. 7.

In the embodiment of FIGS. 7 and 8, heat generated in coil 64 is transferred to heat sink 68 via core parts 54 and 62 and legs 52 and 58. Heat generated in coil 66 is transferred to heat sink 68 via core parts 54 and 62 and legs 52 and 58.

The heat sinks shown in the various embodiments of this invention can take the form of a metallic housing for the electromagnetic apparatus.

The embodiments of the invention in which an exclusive property or privilege is claimed are defined as follows:

1. An electromagnetic apparatus comprising, a metallic heat sink, a rectangular magnetic core comprised of first, second, third and fourth legs, said first and second legs being parallel to each other, said third and fourth legs being parallel to each other, said core having a fifth leg connecting said first and second legs which is parallel to said third and fourth legs, a radially extending coil winding disposed about and carried by said fifth leg, said first, second, third and fourth legs each having a flat surface having predetermined widths which directly engage a flat surface of said heat sink throughout said predetermined widths to thereby provide a direct heat conductive path between all of said legs and said heat sink, said first, second, third and fourth legs all being located normal to said heat sink, each of said first, second, third and fourth legs having spacer portions extending between said flat surface of said heat sink and a surface of said fifth leg, the length of said spacer portions being such that a space is provided between said surface of said fifth leg and said flat surface of said heat sink, said space being long enough to accommodate the entire radial extent of the radially extending portion of said coil winding that faces said flat surface of said heat sink.

2. An electromagnetic apparatus comprising, a metallic heat sink, a magnetic core comprised of at least first and second legs, said first and second legs being parallel to each other, said core having a third leg connecting said first and second legs which is normal to said first and second legs, a radially extending coil winding disposed about and carried by said third leg, said first and second legs each having a flat end surface having predetermined widths which directly engage a flat surface of said heat sink throughout said predetermined widths to thereby provide a direct heat conductive path between said first and second legs and said heat sink, said first and second legs being located normal to said heat sink, each of said first and second legs having spacer portions extending between said flat surface of said heat sink and a surface of said third leg, the length of said spacer portions being such that a space is provided between said surface of said third leg and said flat surface of said heat sink, said space being long enough to accommodate the entire radial extent of the radially extending portion of said coil winding that faces said flat surface of said heat sink.

* * * * *